United States Patent [19]

Hepp

[11] 3,968,889

[45] July 13, 1976

[54] CONVEYOR FOR TRANSPORTING WORKPIECES

[75] Inventor: Günter Hepp, Oberhausen, Germany

[73] Assignee: Koppers-Wistra-Ofenbau Gesellschaft mit beschrankter Haftung, Dusseldorf-Heerdt, Germany

[22] Filed: Nov. 20, 1974

[21] Appl. No.: 525,371

[30] Foreign Application Priority Data

Nov. 28, 1973 Germany ..... 2359160

[52] U.S. Cl. ..... 214/18 R; 198/219; 432/121

[51] Int. Cl.[2] ..... F27B 9/00

[58] Field of Search ..... 214/18 R; 198/219; 432/121, 122

[56] References Cited

UNITED STATES PATENTS 3,871,534 3/1975 Bursk ..... 198/219

*Primary Examiner*—Robert G. Sheridan
*Attorney, Agent, or Firm*—Michael J. Striker

[57] ABSTRACT

A pair of transversely spaced and linked conveyor sections each include an upper support beam elongated in the direction of transport and having upper and lower longitudinal openings, and lifting members shiftably and liftably received in its interior; a lower lifting element extends along and beneath the support beam and converges upwardly toward the same in one longitudinal direction thereof. A wedge-shaped raising element has a planar upper face which extends parallel to an underside of the support beam; the raising element is actuated by the lifting element.

10 Claims, 4 Drawing Figures

CONVEYOR FOR TRANSPORTING WORKPIECES

BACKGROUND OF THE INVENTION

The present invention relates generally to a conveyor, and more particularly for a conveyor for transporting workpieces through heat-exchange zones, that is heating and/or cooling zones.

Conveyors for transporting metallic workpieces through warming ovens or cooling arrangements are already known. For example, German Patent No. 1,269,151 describes a conveyor which is particularly intended for transporting metallic workpieces through a warming oven. The supporting structure of the conveyor is surrounded by thermally insulating means and is cooled. At the center, and the upper portion of each supporting structure, there is provided a longitudinally extending gap through which lifting members are pushed upwardly and outwardly and subsequently retracted again into the thermally protected interior of the supporting structure. In so doing, they lift the workpieces which rest on the supporting structure, upwardly, advance them forward in transport direction, and deposit them again on the supporting structure.

The desired movement of the workpieces requires that the interior of the supporting structure, the lifting members are connected to form a continuous chain, and each lifting member is supported by four rollers which, seen in the transport direction, are spaced at equal distances. These rollers roll on tracks having periodically repeated depressions and crests, the periodicity being equal to the spacing between the rollers.

This and analogous prior-art constructions does not permit the lifting members to perform vertical movements, since the rollers must travel on inclined guide surfaces. This means that at the time the workpieces are engaged for lifting by the lifting members, they are not immediately lifted off the support structure but are first pushed by a certain distance on the same before they are lifted out of contact. Also, when the rollers begin to roll down into a depression and the lifting members therefore begin to descend to deposit the workpieces on the support structure, the roller chain and the chain of lifting elements must be braked. Because of the unavoidable play in these chains, such braking leads to jolting of the chains and the supporting structure.

Moreover, in the prior art using this general type of construction, the rollers must be spaced from one another in the transport direction by quite small distances, in order to maintain the bending stresses acting upon the rollers and the lifting members, as small as possible. Small spacing between the rollers, however, requires very significant inclinations in the ascending and descending portions of the guide tracks on which the rollers move, and this in turn requires that the chains be subjected to strong tensile forces in order to be able to advance them. This means a strong and hence expensive construction.

SUMMARY OF THE INVENTION

Accordingly, it is an object of this invention to provide an improved conveyor of the type in question which is not possessed of the aforementioned disdvantages.

More particularly, it is an object of the invention to provide such an improved conveyor in which the aformentioned disadvantages are overcome and the forces required to effect the transport of workpieces are small.

In keeping with these objects, and with others which will become apparent hereafter, one feature of the invention resides in a conveyor for transporting workpieces through heat-exchange zones. Briefly stated, the conveyor comprises a pair of transversely spaced and linked conveyor sections each including an upper support beam elongated in the direction of transport and having upper and lower longitudinal surfaces, and lifting members shiftably and liftably received in its interior. A lower lifting element extends along and beneath the support beam and converges upwardly toward the same in one longitudinal direction thereof. A wedge-shaped raising element has a planar upper face which extends parallel to an underside of the support beam, and the raising element is actuated by the lifting element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
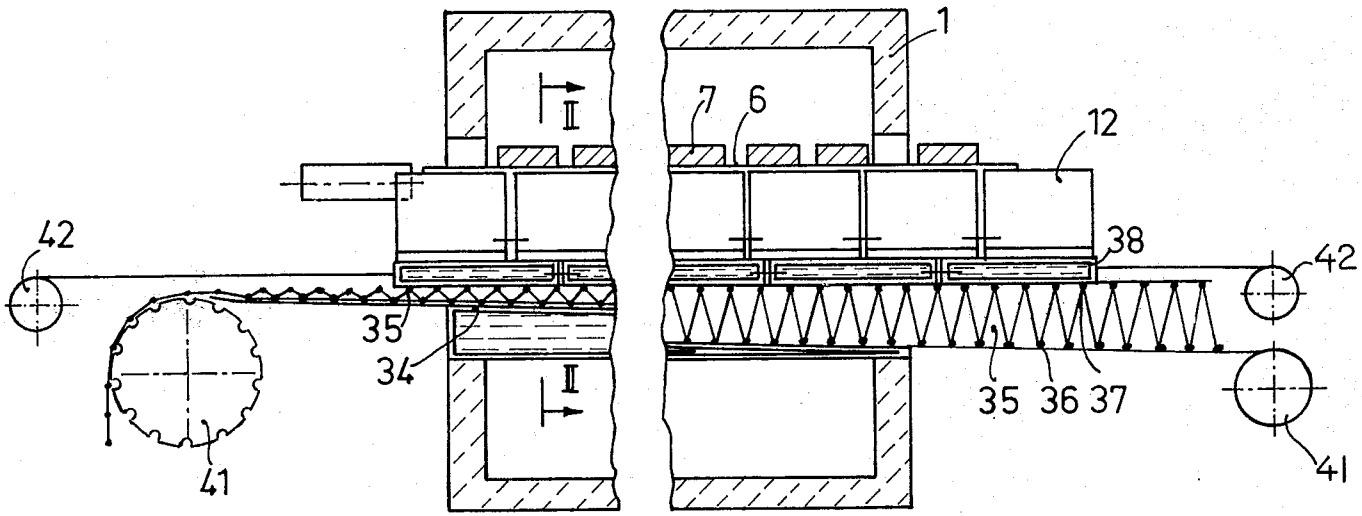
FIG. 1 is a longitudinal section through an arrangement according to the present invention, taken on line I—I of FIG. 2.
Figure 2:
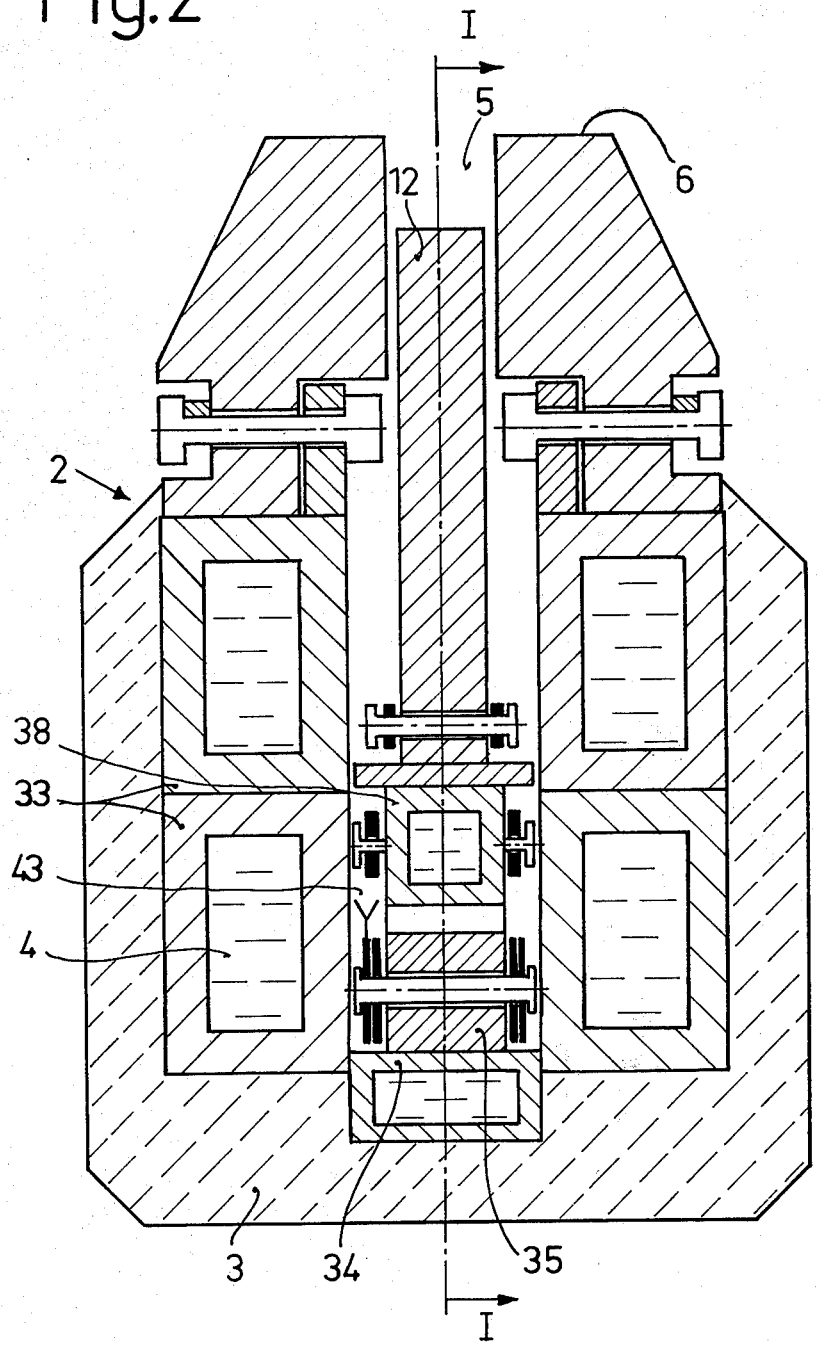
FIG. 2 is a cross section through FIG. 1, taken on line II—II.
Figure 3:
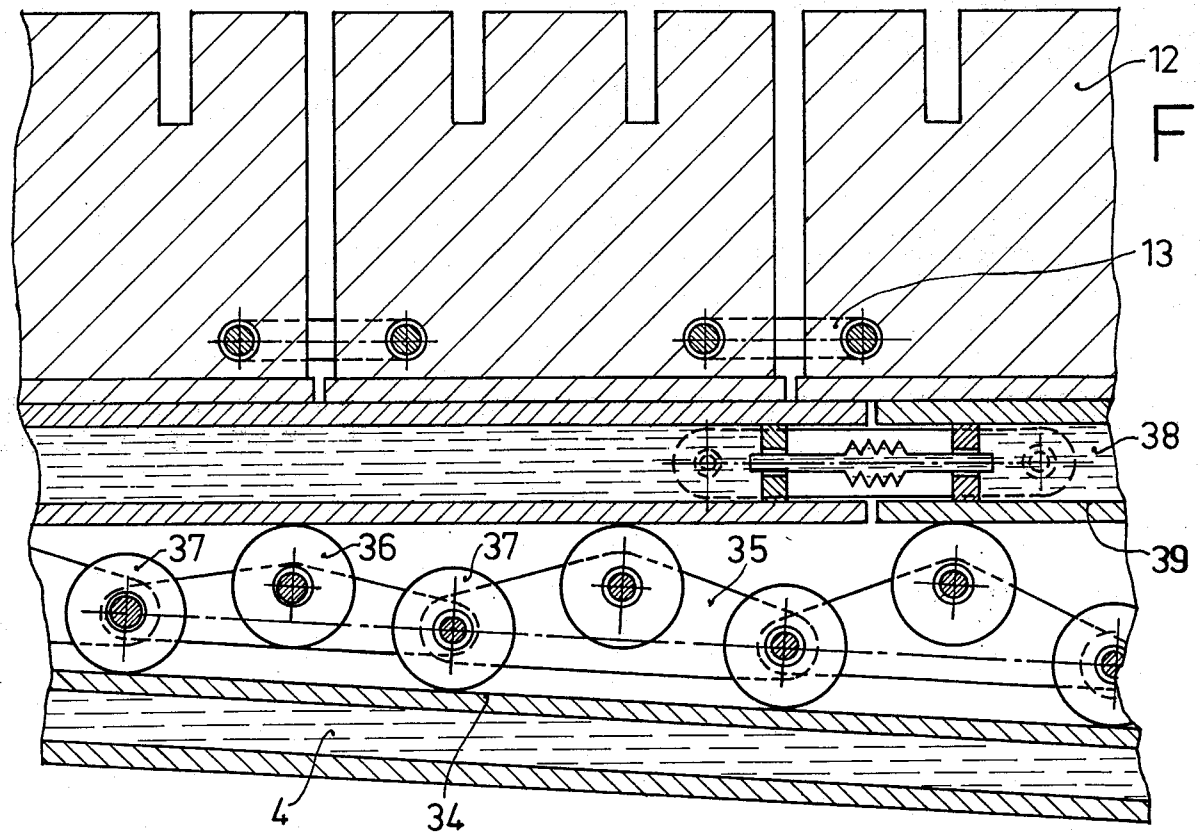
FIG. 3 is a fragmentary enlarged-scale longitudinal section corresponding to I—I of FIG. 2.

FIGS. 1–3 show a first embodiment of the invention wherein the conveyor is mounted within a furnace 1. Such a furnace has at least two supporting structures 2 on the workpiece supporting surfaces 6 of which the workpieces 7 rest when they are not in motion. Each supporting structure 2 is surrounded by heat insulating means 3 and cooled by a cooling system 4. The details of the heat insulation and the cooling system are not important for purposes of the present invention. In the upper portion of each supporting structure 2 there is a centrally located slot 5 having a width corresponding at least to the width of the lifting members 12 which latter are connected by lugs 13 to form chains.

Each of the supporting structures 2 is supported at at least two locations. Two heavy water cooled pairs of pipes, such as steel pipes 33, bridge the distance between the supports and carry the workpieces and the remaining construction. These pairs of pipes 33 are connected by a water cooled track 34 the rolling surface of which is continuously inclined from one end of the conveyor to the other over its entire length.

A lifting arrangement 35 is provided composed of rollers which form a roller chain. The shafts about which the rollers turn are mounted in lugs each of which connects three of these shafts, namely an upper shaft 36 and two lower shafts 37.

The spacing between the roller tracks of the element 35 increases uniformly in one direction, the supporting structure and the lower roller track of the element 35 being so arranged relative to one another that the upper roller track of the element 35 extends horizontally. A transport beam 38 which is composed of a plurality of sections that are connected by lugs, is supported on the upper roller track of the element 35 via its own track 39. Supported on the beam in turn are the lifting members 12 which are connected to form a chain as mentioned before.

Located adjacent the ends of the conveyor are drives 41 and 42. Drive 42 drives both the elements 12 and beam 38 and drive 41 drives the element 35, via roller chain pinions and/or rope pulleys. The drives 41 and 42 may have their pulleys or pinions all mounted on a common shaft so that it is assured that the members 12 and 38 will all travel simultaneously with the element 35 and through identical distances. The element 35 and the elements 12 and the beams 38 are respectively moved to and fro by the drives 41 and 42, so that they alternately move in one and in the opposite direction.

During each transporting movement or stroke the members 12 are moved to and fro through substantially the entire length of the furnace. They therefore perform an additional function besides their transporting function, namely to eject any dirt and contaminants that may have dropped into the construction. For example, the lugs connecting the members 12 to form a chain may be provided with dirt collecting troughs 43 which are subdivided and overlap one another.

Figure 4:
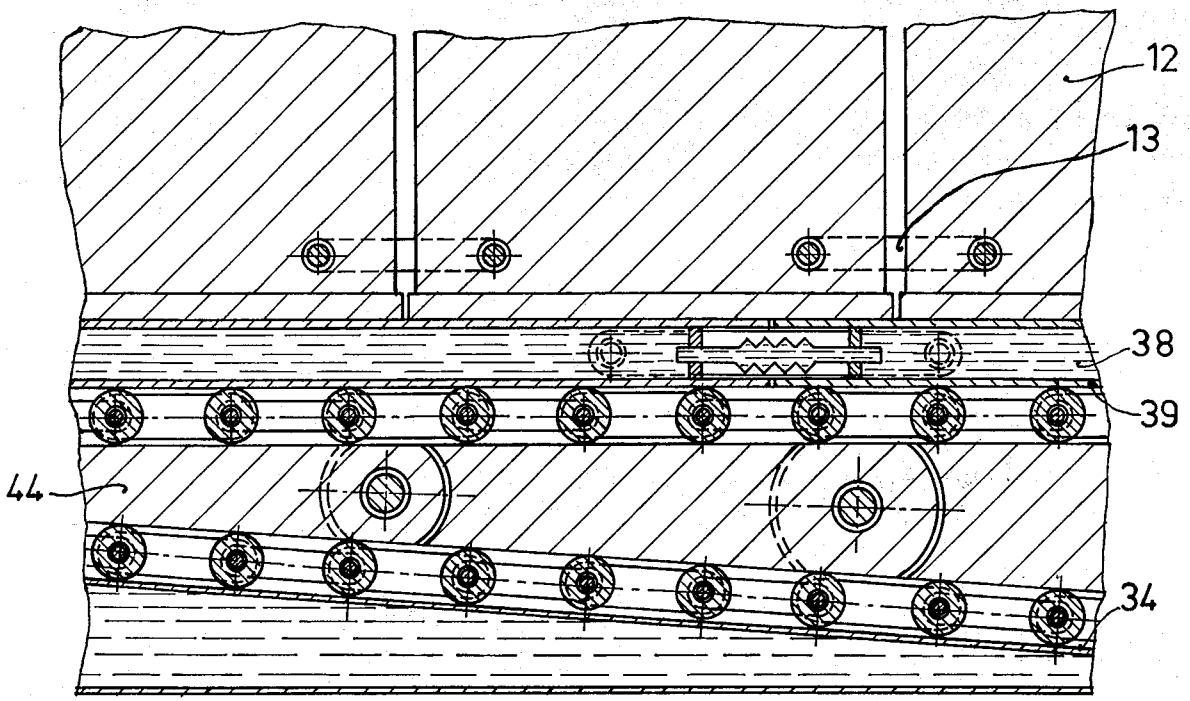
FIG. 4 is a longitudinal section through a further embodiment of the invention.

The embodiment in FIG. 4 is reminiscent of that in FIGS. 1–3, except that here the lifting element is composed of a plurality of massive connected parts 44, and conventional roller chains are located and travel between the parallel tracks of the beam 38 and the lifting element.

When the conveyor according to the present invention is used, and the lifting element is advanced by the drives 40 in the transporting direction, constantly higher portions of the lifting element move beneath the location of the workpieces and effect transportation of the beam on which the workpieces are supported.

Each of the members 12 can be fixedly connected with one of the portions of a transporting beam when the latter is composed of a plurality of portions. The inclination of the parallel track is very small, for example it may be such that 100 mm lift is obtained for the workpieces over a distance of 20,000 mm furnace length; because of this, the forces required for raising the workpieces are very low and the forces for overcoming the rolling friction are also not particularly high. For this reason, only a comparatively small amount of energy is required to drive the conveyor.

It will be understood that each of the elements described above, or two or more together, may also find a useful application in other types of constructions differing from the types described above.

While the invention has been illustrated and described as embodied in a conveyor for conveying workpieces through heat-exchange zones, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristic of the generic or specific aspects of this invention.

What is claimed as new and desired to be protected by Letters Patent is set forth in the appended claims.

1. A conveyor for transporting workpieces through heat-exchange zones, comprising at least one supporting structure which includes a pair of transversely spaced and linked conveyor sections together forming a channel having an open side, said conveyor sections each having a workpiece-supporting surface elongated in the direction of transport and together bounding said open side; and means for lifting and lowering the workpieces relative to said workpiece-supporting surfaces of said conveyor sections and for moving the workpieces in said transport direction, including a support beam elongated in said direction of transport and being movably mounted in said channel, workpiece-lifting members mounted for above said beam shifting and lifting movement relative to said channel, a lifting element extending along and beneath said support beam and converging upwardly towards the same in direction of the elongation thereof, and a wedge-shaped raising element having a planar upper face which extends parallel to an underside of said support beam and which raising element is actuated by said lifting element so as to move said workpiece-lifting members through said open side and thereby lift the workpieces off said workpiece-supporting surfaces and transport the workpieces in said direction of transport.

2. A conveyor as defined in claim 1; and further comprising anti-friction elements interposed between said raising element and said lifting element.

3. A conveyor as defined in claim 1, wherein said support beam is composed of a plurality of portions which are rigidly connected with one another.

4. A conveyor as defined in claim 1, wherein said workpiece lifting members are connected with said support beam.

5. A conveyor as defined in claim 1; and further comprising longitudinally spaced rollers located intermediate said beam and said lifting element.

6. A conveyor as defined in claim 1; further comprising a train of rollers intermediate said beam and said lifting element, said rollers having shafts about which they rotate and some of said shafts being located at a level higher than the other lower shafts, and connectors connecting said rollers to one another, each connector mounting an upper-level shaft and two lower-level shafts.

7. A conveyor as defined in claim 1, said conveyor having spaced ends; and further comprising drive means at least at one of said ends and connected with said conveyor for effecting reciprocating horizontal movement of said beam and workpiece lifting members.

8. A conveyor as defined in claim 2, wherein said anti-friction elements are rollers.

9. A conveyor as defined in claim 1, said conveyor having spaced ends; and further comprising drive means at one of said ends and connected with said conveyor for effecting reciprocating horizontal movement of said raising element.

10. A conveyor as defined in claim 1, wherein said conveyor sections are securely connected with said lifting element.

* * * * *